US008074540B2

(12) United States Patent
Huang

(10) Patent No.: US 8,074,540 B2
(45) Date of Patent: Dec. 13, 2011

(54) ADJUSTABLE WRENCH WITH RATCHET FUNCTION

(75) Inventor: Ping Wen Huang, Wurih Township (TW)

(73) Assignee: New Way Tools Co., Ltd., Taichung ( * ) Notice: Subject to any disclaimer, the term of this patent is extended or adjusted under 35 U.S.C. 154(b) by 325 days.

(21) Appl. No.: 12/539,581

(22) Filed: Aug. 11, 2009

(65) Prior Publication Data

US 2011/0036211 A1 Feb. 17, 2011

(51) Int. Cl.
*B25B 13/22* (2006.01)

(52) U.S. Cl. ..... 81/145; 81/133; 81/157; 81/165

(58) Field of Classification Search ..... 81/133, 81/142–145, 157–158, 148–149, 161–162, 81/173, 165, DIG. 3
See application file for complete search history.

(56) References Cited

U.S. PATENT DOCUMENTS

| | | | | |
|---|---|---|---|---|
| 1,391,251 | A * | 9/1921 | Ginsburg | 81/165 |
| 3,022,689 | A | 2/1962 | McComb | |
| 5,746,098 | A * | 5/1998 | Harrison | 81/143 |
| 5,746,099 | A * | 5/1998 | Janson | 81/165 |
| 6,679,139 | B2 * | 1/2004 | Brenizer | 81/165 |
| 7,137,321 | B1 * | 11/2006 | Huang | 81/126 |

* cited by examiner

*Primary Examiner* — Debra S Meislin
(74) *Attorney, Agent, or Firm* — Wang Law Firm, Inc.; Li K. Wang

(57) ABSTRACT

An adjustable wrench with a ratchet function comprises a fixed jaw 1 and a movable jaw, wherein the fixed jaw has a receiving recess for receiving a screw, a first spring is disposed between the screw and the inner wall of the receiving recess, a shaft is passed through the first spring and the screw, the shaft is formed thereon with a blocking portion for catching a pin, an actuating portion protrudes from the end of the pin, the actuating portion of the pin abuts against the V-shaped push surface of an operating piece, and when pressing one of the ends of the operating piece, the actuating portion of the pin can be pushed by the V-shaped push surface so that the pin moves and disengages from the blocking portion of the shaft. At this time, the wrench can be counter-rotated to quickly perform screw locking action.

6 Claims, 6 Drawing Sheets

ADJUSTABLE WRENCH WITH RATCHET FUNCTION

BACKGROUND OF THE INVENTION (a) Field of the Invention

The present invention relates to an adjustable wrench, and more particularly to an adjustable wrench with a ratchet function.

(b) Description of the Prior Art

In general, when an adjustable wrench is used, the roller is firstly adjusted so that a clamping opening between the fixed jaw and the movable jaw fits the size of a nut followed by performing screw locking (loosening) operation.

However, if in a constrained space, it is generally impossible to continuously rotate the handle of the wrench in the same direction to quickly complete the work, whereas the roller must be slightly screw loosened to enlarge the clamping opening so that it can fit with another two opposing clamping surfaces of the nut to allow continuous rotation. But such repeated operation is significantly inconvenient.

To overcome the drawbacks of the above-mentioned adjustable wrenches, adjustable wrenches with a ratchet function are available on the market. One of them is as shown in FIG. 7, which mainly has a handle 96 to be held by an operator. The handle 96 has a fixed jaw 98 on one end, and a movable jaw 92 is disposed on one side of the fixed jaw 98. The movable jaw 92 engages a roller 91 so as to drive the movable jaw 92 to move. The roller 91 is propped by a compression spring 94 so as to provide a resilient force that moves the movable jaw 92 back and forth in a limited space. A curved spring plate 95 is disposed at the middle section of the handle 96. One end of the spring plate 95 is fixed at the handle 96, and the bottom of the other end thereof is provided with a projecting portion 951 connected to a spring lock 93. One end of the spring lock 93 extends to one side of the roller 91 and is formed with a stopper portion 931 to stop the movement of the roller 91, so as to provide a fixed opening between the fixed jaw 98 and the movable jaw 92 for convenience of rotating workpieces. Pressing the spring plate 95 at the middle section of the handle 96 would release the stopper portion 931 of the spring lock 93 on stopping the roller 91, so that the movable jaw 92 can move freely for convenience of rotating the adjustable wrench.

Nevertheless, defects in structural design of the above-mentioned adjustable wrench may cause the problems such as failure in operation and false touches in practical use. As shown in FIG. 8, since there is an elongated space 97 significantly exposed and located between the spring plate 95 of the wrench and the side face of the handle 96, dusts and trash from the workplace will be accumulated therein after long time use, so that the spring plate 95 is stuck and cannot be effectively pressed to cause the problem of failure in operation.

In addition, as shown in FIGS. 7 and 8, both of the above-mentioned spring plate 95 and spring lock 93 are designed as elongated strips and exposed from the surface of the wrench. Hence, it is easy to cause deformation when the spring plate 95 or the spring lock 93 is hit by an external force. Once the spring plate 95 or the spring lock 93 is deformed, this would cause the problem of failure in operation.

Moreover, the spring plate 95 is located on one side face of the handle 96. Therefore, when the wrench needs to be used on its reverse side due to the working environment, this is bound to have the difficulty in pressing the spring plate.

SUMMARY OF THE INVENTION

It is a first object of the present invention to provide an adjustable wrench with a ratchet function, which has the features of convenient operation and back-and-forth rotation.

It is a second object of the present invention to provide an adjustable wrench with a ratchet function, which is operable on both sides, thus significantly increasing the practicality of the present invention.

To achieve the foregoing object, the adjustable wrench with a ratchet function according to the present invention comprises:

a fixed jaw having a receiving recess provided thereon with a slideway in communication with the receiving recess, and a through hole disposed below the receiving recess;

a movable jaw disposed in the slideway of the fixed jaw and laterally movable along the slideway, and a toothed portion formed at the bottom of the movable jaw;

a screw disposed in the receiving recess of the fixed jaw and having an external thread section, the screw engaging the toothed portion at the bottom of the movable jaw, and a first spring disposed between the screw and the inner wall of the receiving recess;

a shaft passed through the first spring and the screw to drive the screw so that the screw compresses the first spring and moves transversely, and the shaft formed with a blocking portion;

a positioning assembly disposed in the fixed jaw, the top of the positioning assembly is caught within the blocking portion of the shaft into engagement with each other, and an actuating portion protruding from the end of the pin toward the side of the through hole;

a pushing assembly disposed in the fixed jaw and extending toward the through hole; and an operating piece disposed in the through hole, the both ends of the operating piece respectively extending out of the through hole, the operating piece having a first V-shaped push surface formed at the position corresponding to the actuating portion and having a second V-shaped push surface formed at the position corresponding to the pushing assembly, the actuating portion and the pushing assembly respectively abutting against the central turning positions of the V-shaped push surfaces, and when pressing one of the ends of the operating piece, the positioning assembly or the pushing assembly can be pushed and moved by the corresponding V-shaped push surface so as to release the engagement of the positioning assembly with the shaft.

DETAILED DESCRIPTION OF THE PREFERRED EMBODIMENTS

Figure 1:
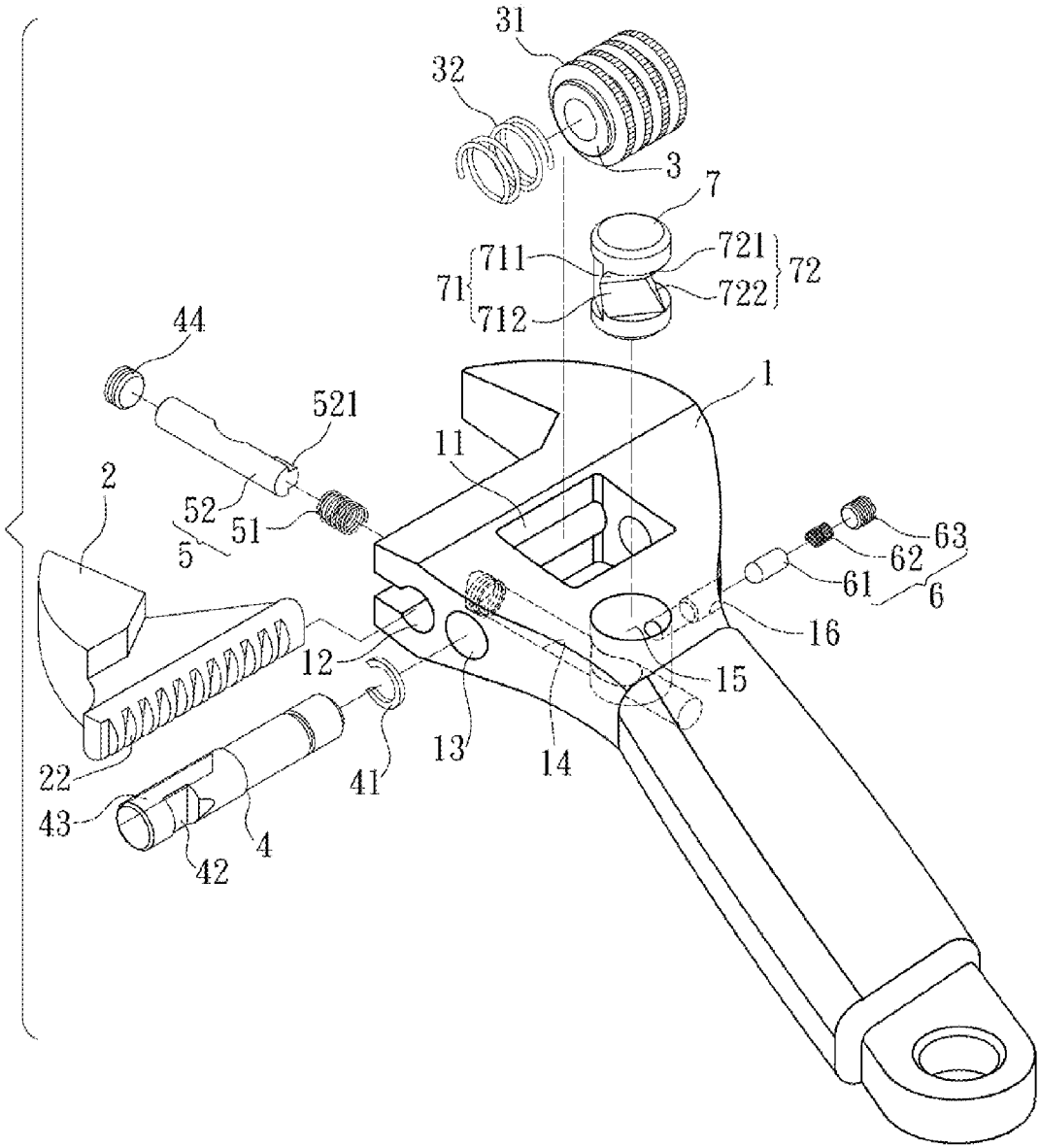
FIG. 1 is a schematic three-dimensional exploded view of the present invention.
Figure 2:
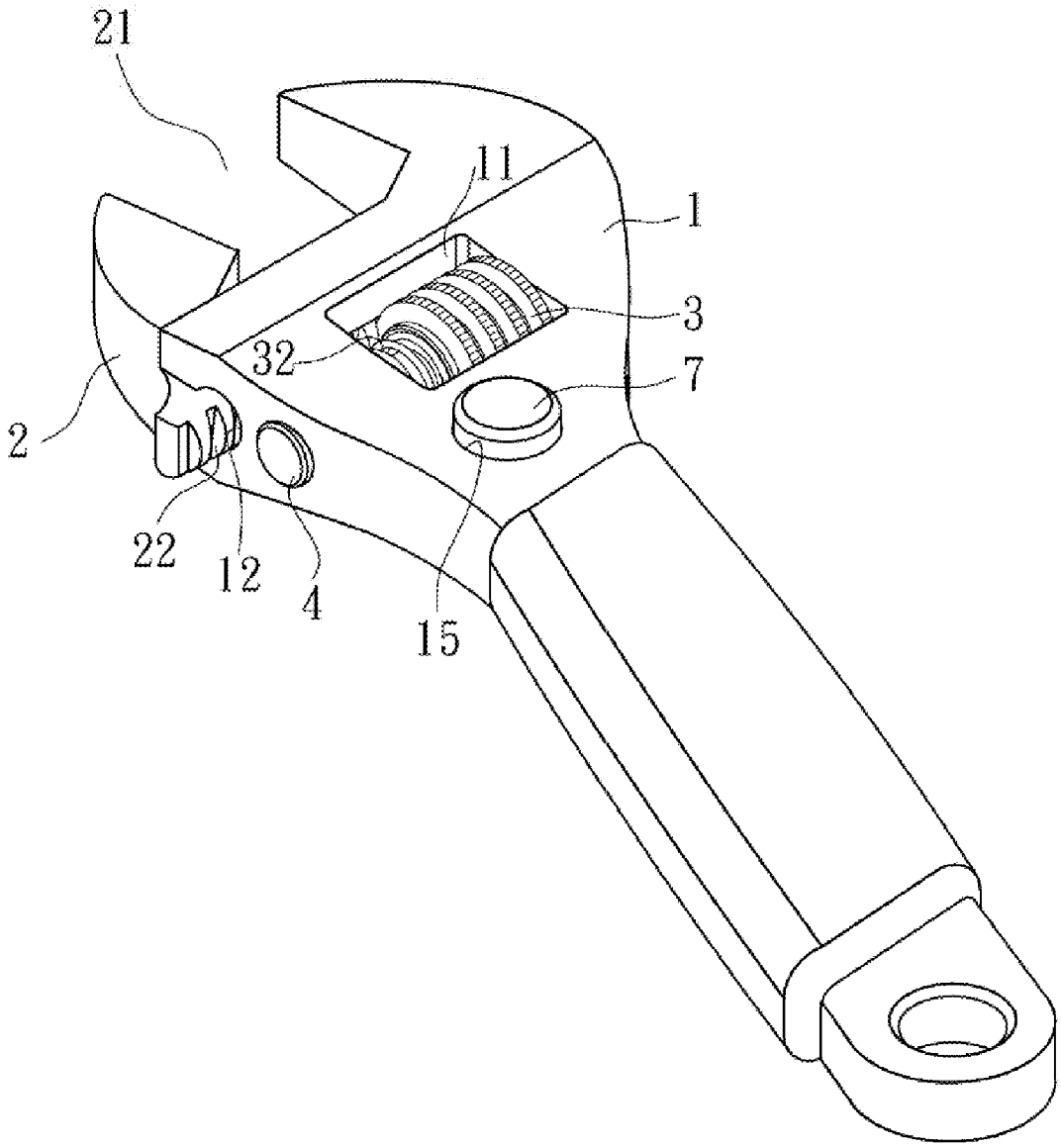
FIG. 2 is a schematic three-dimensional view of a structure after assembled according to the present invention.
Figure 3:
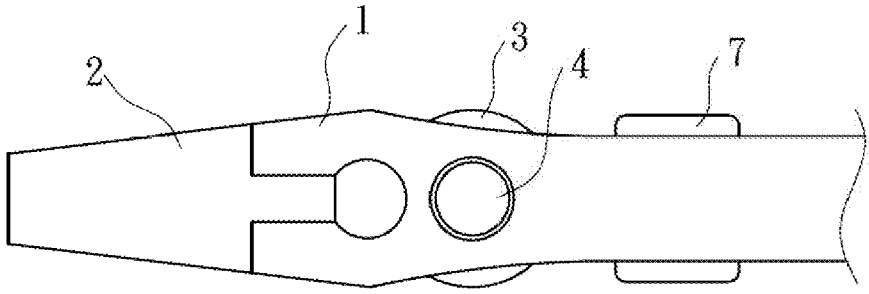
FIG. 3 is a side view of a structure after assembled according to the present invention.

First, referring to FIGS. 1 to 3, the present invention provides an adjustable wrench with a ratchet function, which is mainly comprised of a fixed jaw 1, a movable jaw 2, a screw 3, a shaft 4, a positioning assembly 5, a pushing assembly 6, and an operating piece 7.

The fixed jaw 1 has a receiving recess 11 that is provided thereon with a slideway 12 in communication with the receiving recess 11. A bore 13 is laterally disposed through one side of the receiving recess 11. An opening 14 is radially disposed through the bore 13. A through hole 15 is disposed at a lower position of the fixed jaw 1 with respect to the receiving recess 11. Further, an additional hole 16 is laterally disposed on the side of the fixed jaw 1 different from the side on which the opening 14 is arranged, and the opening 14 and the additional hole 16 respectively communicate with the through hole 15.

The movable jaw 2 is disposed in the slideway 12 of the fixed jaw 1 and laterally movable along the slideway 12 so that a clamping opening 21 with a variable spacing is defined between the movable jaw 2 and the fixed jaw 1. A toothed portion 22 is formed at the bottom of the movable jaw 2.

The screw 3 is disposed in the receiving recess 11 of the fixed jaw 1 and has an external thread section 31 which engages the toothed portion 22 at the bottom of the movable jaw 2 so that rotation of the screw 3 can cause transverse motion of the movable jaw 2 to adjust the spacing of the clamping opening 21. A first spring 32 is disposed between the screw 3 and the inner wall of the receiving recess 11.

The shaft 4 is passed from the bore 13 through the first spring 32 and the screw 3 and connected with the screw 3 by snap fitting of a snap ring 41 to drive the screw 3 so that the screw 3 compresses the first spring 32 and moves transversely. The shaft 4 is recessed at the position corresponding to the opening 14 and formed with a blocking portion 42. The shaft 4 has a contact surface 43 which faces toward the toothed portion 22 of the movable jaw 2 and abuts against a stopper member 44 so as to restrict the rotation of the shaft 4 that is rotated by the screw 3.

The positioning assembly 5 is disposed in the opening 14 and includes a second spring 51 and a pin 52. The second spring 51 is disposed at the bottom of the opening 14 to push the end of the pin 52 so that the top of the pin 52 is caught within the blocking portion 42 of the shaft 4 into engagement with each other. An actuating portion 521 protrudes from the end of the pin 52 toward the side of the through hole 15.

The pushing assembly 6 is disposed in the additional hole 16 and sequentially includes a pushing member 61, a third spring 6 and a screw cap 63. The third spring 62 pushes the pushing member 61 to extend toward the through hole 15.

The operating piece 7 is adapted to mate with the through hole 15 and thus can be disposed in the through hole 15. The axial length of the operating piece 7 is larger than the depth of the through hole 15 so that when the operating piece 7 is received in the through hole 15, the both ends of the operating piece 7 respectively extend out of the through hole 15. The operating piece 7 has a first V-shaped push surface 71 formed at the position corresponding to the actuating portion 521 of the pin 52, and further has a second V-shaped push surface 72 formed at the position corresponding to the pushing member 61. The V-shaped push surfaces 71, 72 respectively have first inclined sections 711, 721 and second inclined sections 712, 722. The actuating portion 521 and the pushing member 61 respectively abut against the central turning positions of the first inclined sections 711, 721 and the second inclined sections 712, 722 of the V-shaped push surfaces 71, 72. When the user presses one of the ends of the operating piece 7, the actuating portion 521 of the pin 52 or the pushing member 61 can be pushed and moved by one of the inclined sections of the corresponding V-shaped push surface 71, 72, so that the top of the pin 52 disengages from the blocking portion 42 of the shaft 4 to release the engagement with the shaft 4.

Figure 4:
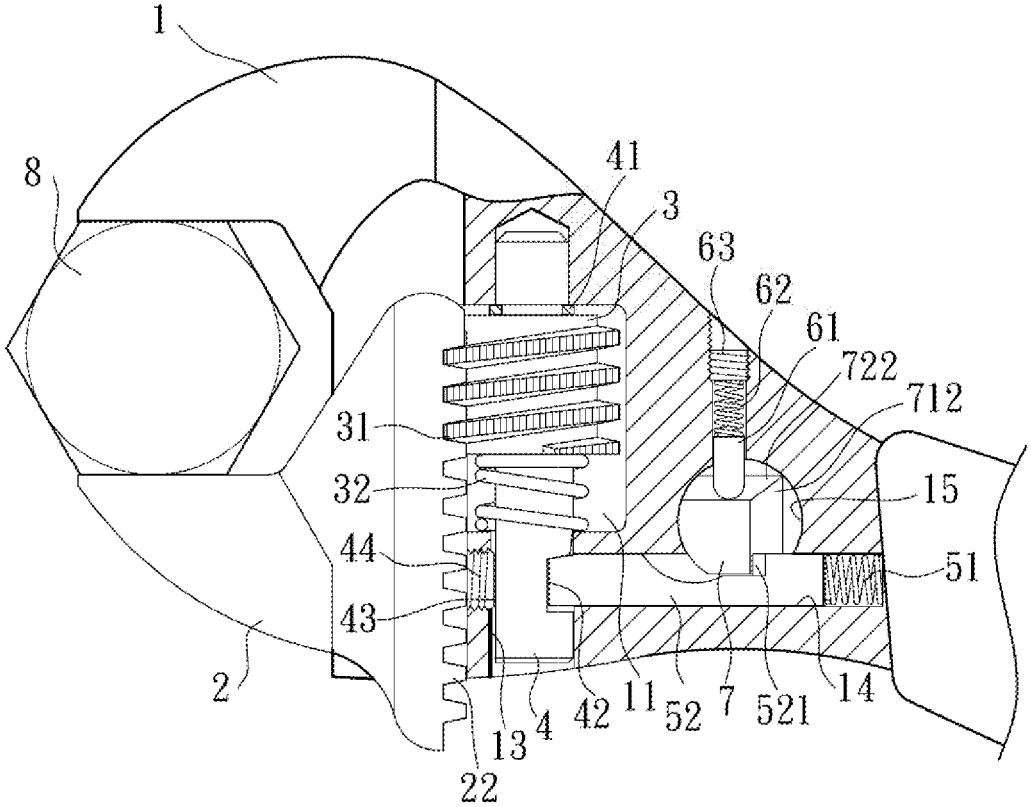
FIG. 4 is a schematic view showing a usage state where the clamping opening receives a polygonal screw piece according to the present invention.

When the user desires to screw tight a polygonal screw piece 8, as shown in FIG. 4, the user firstly turns the screw 3 to adjust the spacing of the clamping opening 21, so as to clamp the polygonal screw piece 8. At this time, the shaft 4 and the pin 52 mutually engage so that the clamping opening 21 is maintained at a fixed spacing, thereby smoothly screwing tight the polygonal screw piece 8.

Figure 5:
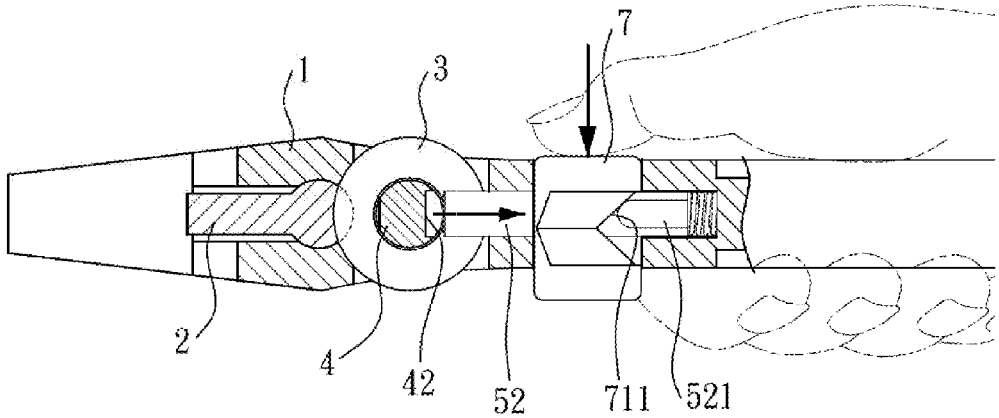
FIG. 5 is a schematic view showing a usage state where the operating piece is pressed according to the present invention.
Figure 6:
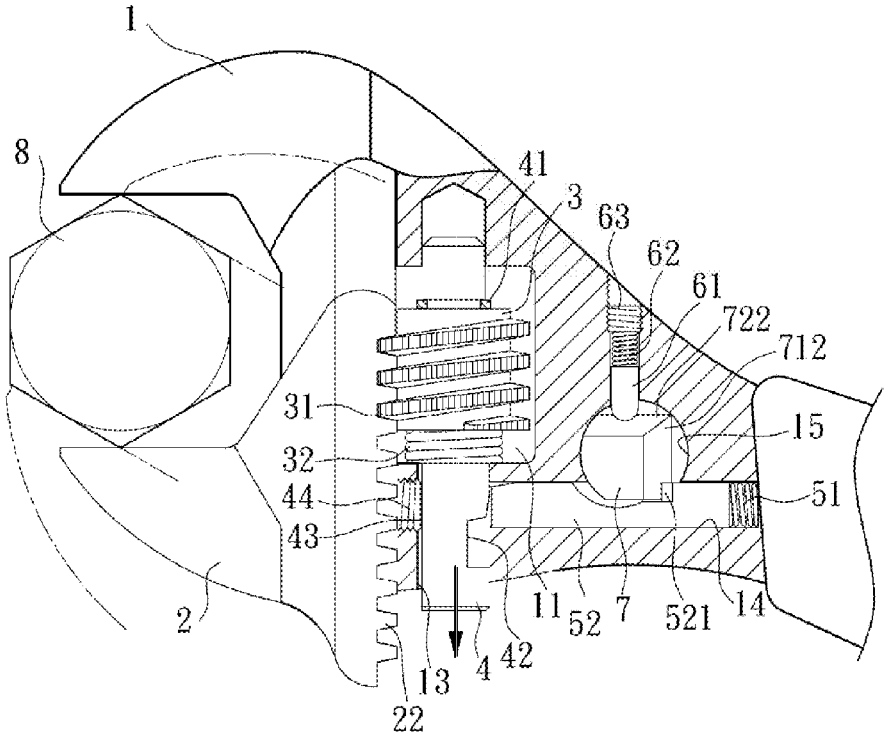
FIG. 6 is a schematic view showing a usage state where the operating piece is pressed and the wrench is counter-rotated according to the present invention.
Figure 7:
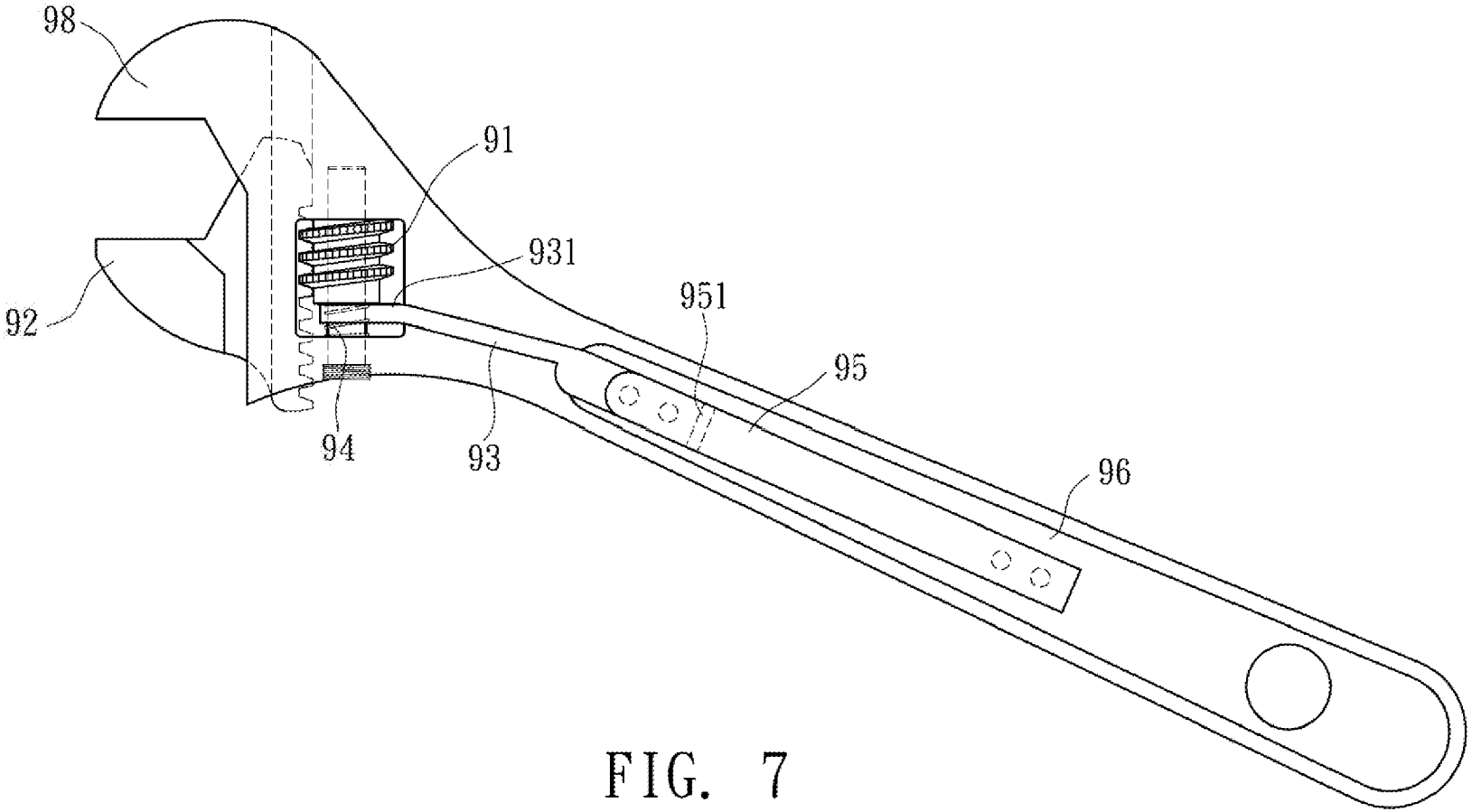
FIG. 7 PRIOR ART
FIG. 7 is a schematic view showing a structure of a conventional adjustable wrench with a ratchet function.
Figure 8:
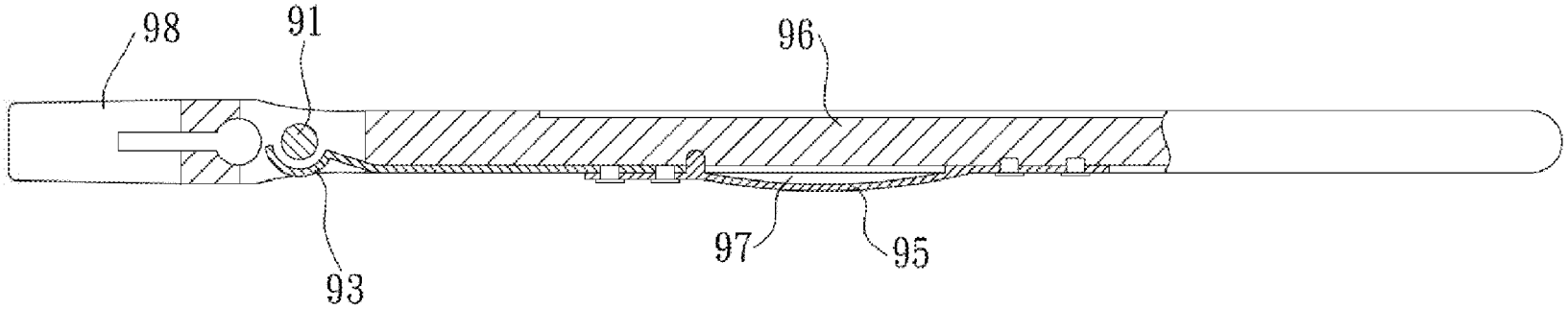
FIG. 8 PRIOR ART
FIG. 8 is a schematic cross-sectional view of a conventional adjustable wrench with a ratchet function.

When the operator desires to rotate the wrench in the counter direction, as shown in FIGS. 5 and 6, the operator only needs to press the end face of the operating piece 7 exposed from the through hole 15 by a thumb. At this time, the actuating portion 521 of the pin 52 can be pushed by the first inclined section 711 of the first V-shaped push surface 71 of the operating piece 7, so that the top of the pin 52 disengages from the blocking portion 42 of the shaft 4 to release the engagement with the shaft 4. In like manner, when the operator needs to use the wrench on its reverse side due to the working environment, the operator can also press the other end face of the operating piece 7 by a thumb, so as to push the actuating portion 521 of the pin 52 by the second inclined section 712 of the first V-shaped push surface 71 of the operating piece 7. Therefore, this would not lead to the difficulty in pressing the operating piece 7 when the wrench is used on its reverse side.

The pushing member 61 of the pushing assembly 6 abuts against the second V-shaped push surface 72 on the other side of the operating piece 7. As a result, when the operating piece 7 is pressed, as shown in FIG. 6, the first inclined section 721 of the second V-shaped push surface 72 of the operating piece 7 pushes the pushing member 61 to compress the third spring 62. The operating piece 7 can further be pushed on its different side faces by means of the actuating portion 521 of the pin 52 and the pushing member 61, so that the operator can press the operating piece 7 more stably. When the front end of the movable jaw 2 is pushed by an obtuse corner of the polygonal screw piece 8, the movable jaw 2 and the screw 3 interlocked with the shaft 4 are pushed and moved outwardly together, so that the first spring 32 in the receiving recess 11 is compressed by the screw 3 and in a compression state (as shown in FIG. 6). Thus, the spacing of the clamping opening 21 is slightly increased to achieve the effect of rotating the wrench in the counter direction. When the wrench is rotated to another two opposing clamping surfaces, the screw 3 would be pushed by the restoring resilient force of the first spring 32 so as to drive the movable jaw 2 to move and decrease the spacing of the clamping opening 21.

Subsequently, when the user moves his or her thumb away from the operating piece 7 to release the pressing operation, the pin 52 would be driven by restoring resilient force of the second spring 51 and caught within the blocking portion 42 of the shaft 4 again (as shown in FIG. 4). At this time, the operating piece 7 is pushed by the actuating portion 521 of the pin 52 driven by the second spring 51 and returns to an unpressed position again. In this manner, the polygonal screw piece 8 can be screwed tight again. It is possible to perform one-directional continuous screw locking action by continuously repeating the above steps, thereby eliminating the repeating operation, such as moving away, leaning against, etc. Furthermore, the operating piece 7 can be pushed on its different side faces by means of the actuating portion 521 of the pin 52 and the pushing member 61, so that the operating piece 7 can reset in a relatively stable manner.

Moreover, the operating piece and the through hole of the present invention are adapted to mate with each other. As a result, this can further effectively prevent dusts and impurities from entering and clogging the through hole so as to extend the service life.

What is claimed is:

1. An adjustable wrench with a ratchet function comprising:

a fixed jaw having a receiving recess provided thereon with a slideway in communication with said receiving recess, a bore laterally disposed through one side of said receiving recess, an opening radially disposed through said bore, a through hole disposed below said receiving recess, an additional hole laterally disposed on the side of said fixed jaw different from the side on which said opening is arranged, and said opening and said additional hole respectively communicating with said through hole;

a movable jaw disposed in said slideway of said fixed jaw and laterally movable along said slideway so that a clamping opening with a variable spacing is defined between said movable jaw and said fixed jaw, and a toothed portion formed at the bottom of said movable jaw;

a screw disposed in said receiving recess of said fixed jaw and having an external thread section which engages the toothed portion at the bottom of said movable jaw, and a first spring disposed between said screw and the inner wall of said receiving recess;

a shaft passed from said bore through said first spring and said screw to drive said screw so that said screw compresses said first spring and moves transversely, and said shaft recessed at the position corresponding to said opening and formed with a blocking portion;

a positioning assembly disposed in said opening and including a second spring and a pin, said second spring disposed at the bottom of said opening to push the end of said pin so that the top of said pin is caught within said blocking portion of said shaft into engagement with each other, and an actuating portion protruding from the end of said pin toward the side of said through hole;

a pushing assembly disposed in said additional hole and sequentially including a pushing member, a third spring and a screw cap, and said third spring pushing said pushing member to extend toward said through hole; and an operating piece disposed in said through hole, the both ends of said operating piece respectively extending out of said through hole, said operating piece having a first V-shaped push surface formed at the position corresponding to said actuating portion of said pin and having a second V-shaped push surface formed at the position corresponding to said pushing member, said actuating portion and said pushing member respectively abutting against the central turning positions of said V-shaped push surfaces, when pressing one of the ends of said operating piece, said actuating portion of said pin or said pushing member is pushed and moved by said corresponding V-shaped push surface so that the top of said pin disengages from said blocking portion of said shaft to release the engagement with said shaft.

2. The adjustable wrench with a ratchet function as claimed in claim 1, wherein said shaft is passed from said bore through said first spring and said screw and connected with said screw by snap fitting of a snap ring.

3. The adjustable wrench with a ratchet function as claimed in claim 1, wherein said shaft has a contact surface which faces toward said toothed portion of said movable jaw and abuts against a stopper member so as to restrict the rotation of said shaft that is rotated by said screw.

4. The adjustable wrench with a ratchet function as claimed in claim 1, wherein said operating piece correspondingly mates with said through hole.

5. The adjustable wrench with a ratchet function as claimed in claim 1, wherein said V-shaped push surfaces of said operating piece respectively have first inclined sections and second inclined sections, and said actuating portion and said pushing member respectively abut against the central turning positions of said first inclined sections and said second inclined sections of said V-shaped push surfaces.

6. The adjustable wrench with a ratchet function as claimed in claim 5, wherein when one of the ends of said operating piece is pressed, said actuating portion of said pin or said pushing member is pushed and moved by one of said inclined sections of said corresponding V-shaped push surface.

* * * * *